US005268965A

United States Patent [19]

Badie et al.

[11] Patent Number: 5,268,965

[45] Date of Patent: Dec. 7, 1993

[54] USER SELECTABLE NOISE CANCELING FOR PORTABLE MICROPHONES

[75] Inventors: Merhdad Badie, Sunrise; William R. Williams, N. Lauderdale, both of Fla.

[73] Assignee: Motorola, Inc., Schaumburg, Ill.

[21] Appl. No.: 41,921

[22] Filed: Apr. 2, 1993

Related U.S. Application Data

[63] Continuation of Ser. No. 793,966, Nov. 18, 1991, abandoned.

[51] Int. Cl.[5] ..... H04R 1/02

[52] U.S. Cl. ..... 381/91; 381/122; 381/169

[58] Field of Search ..... 381/169, 170, 122, 91; 455/100

[56] References Cited

U.S. PATENT DOCUMENTS 3,114,105 12/1963 Neumiller ..... 381/91
3,370,236 2/1968 Walker ..... 455/89
4,051,330 9/1977 Cole ..... 381/68.1

*Primary Examiner*—Forester W. Isen
*Attorney, Agent, or Firm*—M. Mansour Ghomeshi

[57] ABSTRACT

Briefly, according to the invention, a noise-cancelling microphone apparatus 302 is disclosed. The microphone comprises a housing 510 and a sound transducer 502 mounted within the housing 510. The housing has first 514 and second sides 512 and the transducer 502 has first 304 and second sound ports 308 coupled to the first 514 and second sides 512 of the housing respectively. The microphone 302 also includes a mounting clip 310 coupled to one side of the housing 512 in the proximity of one of the sound ports 308. The mounting clip 310 is intended for mounting the microphone 302 to a user so as to substantially close the sound port 308 when microphone 302 is attached.

10 Claims, 3 Drawing Sheets

USER SELECTABLE NOISE CANCELING FOR PORTABLE MICROPHONES

This is a continuation of application Ser. No. 07/793,966, filed on Nov. 18, 1991 and now abandoned.

TECHNICAL FIELD

This invention relates generally to microphones and more particularly to directional microphone.

BACKGROUND

A directional microphone utilizes front and rear porting to sense the difference between the instantaneous air pressures which impinge on its two surfaces. If an unwanted sound arrives from front of the user, who is talking directly into front of the microphone, it will pass the rear inlet first and with a distance delay reaches the front inlet (facing the user). An internal delay at the rear inlet to the diaphragm is optimally designed to time to cancel the distance delay, thus allowing the unwanted sound to reach the diaphragm from both inlets simultaneously and therefore being cancelled. Directional microphones have traditionally been used with portable units. In many applications directional microphones are remotely located, either attached to ones clothing or to a strap belt, both for hands free operation. Referring to FIG. 1, an example of the attachment of a microphone 102 to the clothing of an operator 106 is shown. The microphone 102 includes a front port 104 and a rear port 108 (in the back, not shown). Since the operator can no longer speak directly into the front port 104 his voice waves reach the rear port 108 out of timing sync with those reaching the front port 104. This timing corruption, essential to the operation of the directional microphone 102, results in a reduction of the level of the electrical signal produced by the microphone 102 in response to the voice waves. In many situations this problem is so significant that the operator is forced to remove the microphone and use it in a hands on manner defeating the purpose of the remoteness of the microphone. It is therefore clear that a need exists for a directional microphone that can also be used in hands free applications where the operator does not directly talk into the microphone.

SUMMARY OF THE INVENTION

Briefly, according to the invention, a noise-cancelling microphone apparatus is disclosed. The microphone comprises a housing and a sound transducer mounted within the housing. The housing has first and second sides and the transducer has first and second sound ports coupled to the first and second sides of the housing respectively. The microphone also includes a mounting means coupled to one side of the housing in the proximity of one of the sound ports. The mounting means is intended for mounting the microphone to a user so as to substantially close the sound port when microphone is attached.

DETAILED DESCRIPTION OF THE PREFERRED EMBODIMENT

Figures 2A, 2B:
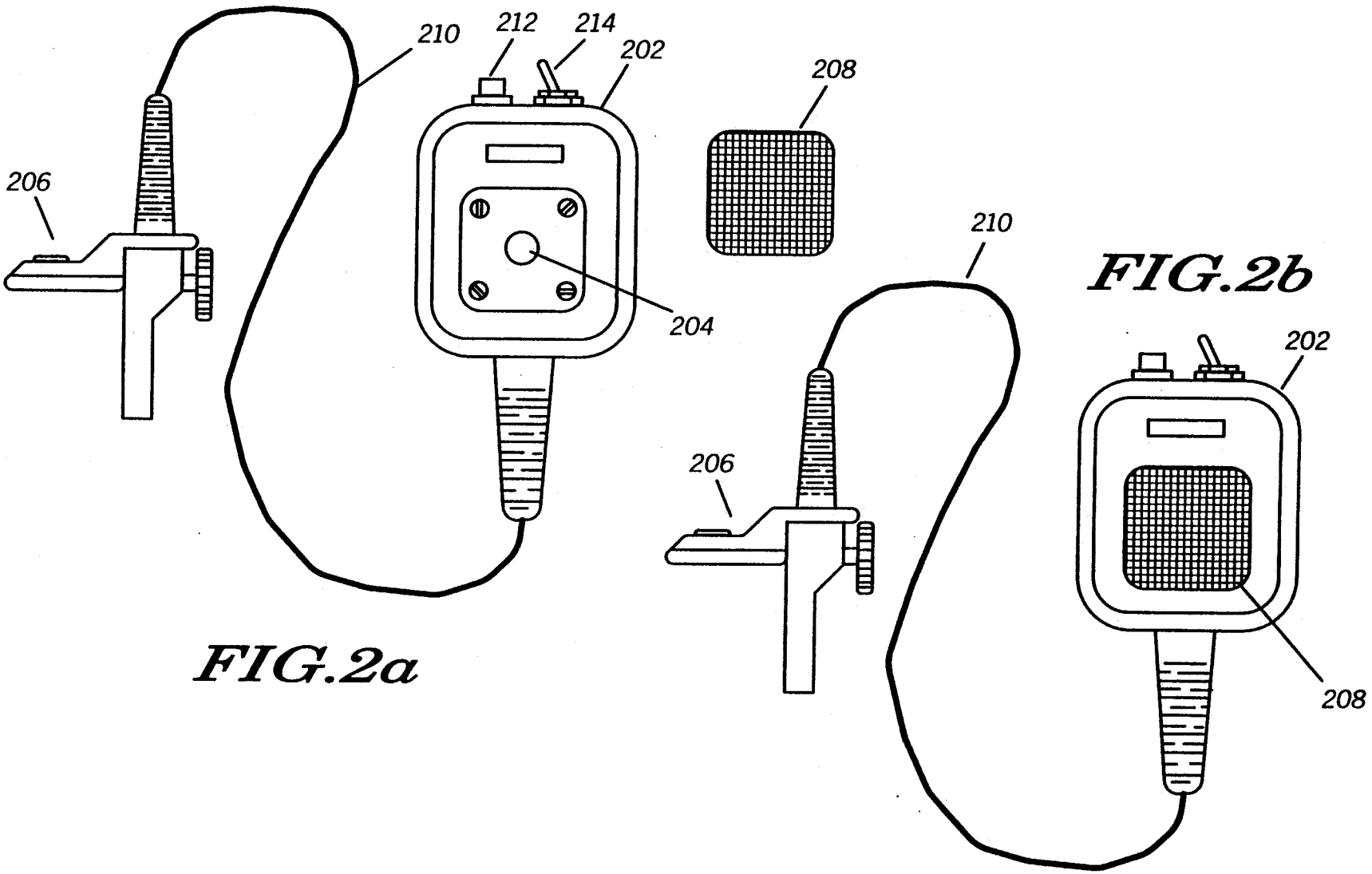
FIG. 2*a* and 2*b* are perspective views of a directional microphone showing the attachment of a hook and loop fastener in accordance with the present invention.

Referring to FIG. 2*a*, a perspective view of a microphone 202 is shown in accordance with the present invention. The microphone 202 includes a rear port 204 and a front port (not shown). These two ports are connected to a directional transducer included in the electronics of the microphone 202. The front and rear ports 204 channel the available sound waves to the transducer which produces a proportional electrical signal. The available sound waves include waves from ambient noise signals. The front and rear ports 204 along with the directional transducer work together to render the microphone 202 directional. The operation of directional microphones is well known in the art. Sound waves directed at the front port are properly converted to electrical signals. However, noise waves not directed at any particular port are cancelled. The rear port 204 is surrounded with a hook and loop fastener such as a velcro piece 216 which is used to attach the microphone 202 to a stand or to an operator's clothing. Volume control and channel selections are provided via 212 and 214 respectively and are not related to this invention. A screw on connector 206 is provided to connect the microphone 202 to a device it is meant to operate with, such as a communication device. The connection between the hand held microphone 202 and the connector 206 is provided via the cable 210. A piece of velcro patch 208 comprising hook and loop fastener means is used by the operator to attach the microphone 202 to his clothing or his belt strap. The velcro patch 208 is placed and attached to an operator's clothing or his strap using adhesives, a safety pin, or it is simply sowed on. Later when the operator wishes to use his microphone 202 hands free, he proceeds with attaching the two velcro pieces 208 and 216 together.

FIG. 2*b* shows the microphone 202 with its velcro piece 216 attached to the velcro patch 208. The attachment of the microphone 202 to the velcro patch 208 results in the obstruction of the rear port 204. This obstruction greatly reduces the flow of sound signals to the rear port 204 leaving only the front port as the means of receiving sound signals. With only one port operating, the microphone 202 is rendered omni-directional. That means that the effects of the ambient noise cancelling port are substantially minimized. As described, the conversion of the directional microphone 202 to omni-directional is entirely selective and automatic. That is as the operator removes the microphone 202 form his shirt or his strap, the obstruction of the rear port 204 is removed which results in the microphone 202 returning to its directional mode of operation. This generally happens when the operator intends to hold the microphone 202 and talk into it.

In summary a directional microphone 202 having a front and rear port 204 is rendered omni-directional as it is attached to the clothing of an operator via a hook and loop fastener such as velcro patch 208. As the velcro patch 208 attaches to the velcro piece 216 the rear port 204 is blocked. The blocking of the rear port 204 minimizes the effects of the noise cancelling that is inherent to the directional microphone 202.

Figure 3A:
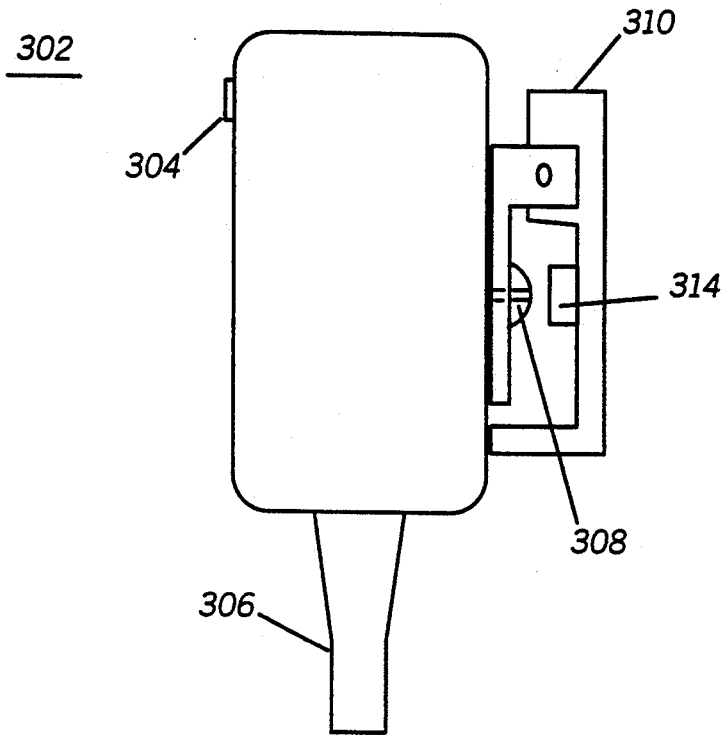
FIG. 3*a* and 3*b* are perspective views of a directional microphone showing a clip on fastener in accordance with the present invention.

Referring to FIG. 3*a*, a side view of an alternative embodiment of the present invention is shown. A microphone apparatus 302 is shown to include a front port 304 and a rear port 308. These two ports 304 and 308 render the microphone 302 directional in regular hand held operation and as the operator speaks directly into the front port 304. Internal to the microphone 302, there is a transducer intended for producing electrical signals in response to sound waves. Ambient noise is greatly eliminated from being converted to electrical signal by the cancelling features of the microphone 302. A clip 310 is used to clip the microphone 302 to an operator's shirt or his strap belt and provides the mounting means for the microphone 302. A cable 306 provides electrical connection between the microphone 302 and an electronic device the microphone 302 is intended to operate with. As can be seen in FIG. 3*a*, the rear port 308 is open indicating that the operation of the microphone 302 is directional.

Figure 3B:
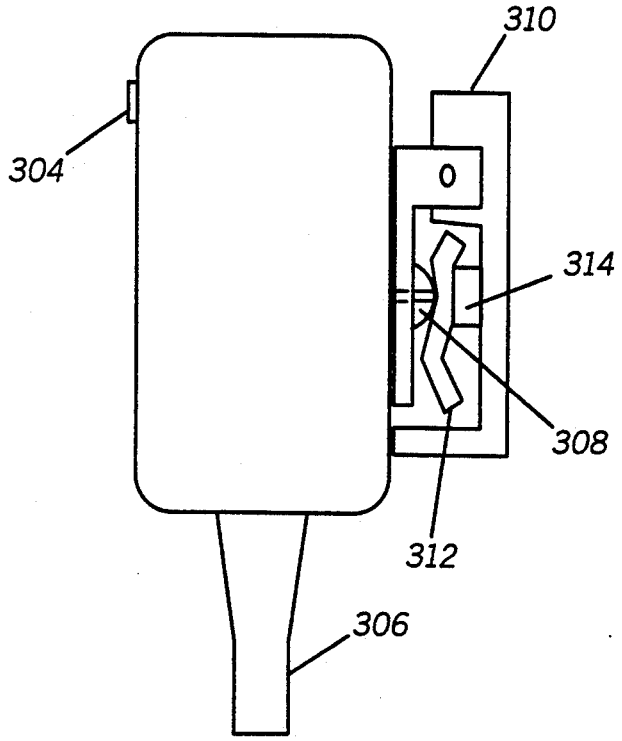

Referring to FIG. 3*b* now, the microphone 302 is shown attached to the operator; either on his clothing or to his strap belt. A portion of the clothing or the strap is shown by 312. It can be seen that strap 312 is being pushed in by a pad 314 and therefore blocking the rear port 308. The material used for the pad 314 is preferably rubber. This blockage of the rear port 308 greatly reduces the entrance of the sound waves to the transducer of the microphone 302. Since the directional operation of the microphone 302 is dependent on the rear port 308, the result is an omni-directional microphone. With the microphone 302 omni-directional, the position of the operator's mouth and the location of the two ports 304 and 308 is not significant from a noise cancelling stand point. Once again it is evident that the conversion from directional to omni-directional is user selectable and does not require any additional actions taken by the operator. Furthermore, the blocking of the rear port 308 may be accomplished by a switch, preferably mechanical. The operator activates a mechanical switch which results in the rear port 308 being blocked. Microphones not intended for remote operation can take special advantage of such a switch.

In summary, a directional microphone 302 is converted to an omni-directional microphone via the action of clipping the microphone to the clothing of the operator. By clipping the microphone 302 to the clothing of the operator, the rear port 308, providing noise cancelling to the microphone 302, is blocked. This blockage reduces the effects of the noise cancelling operation of the microphone 302.

Figure 1:
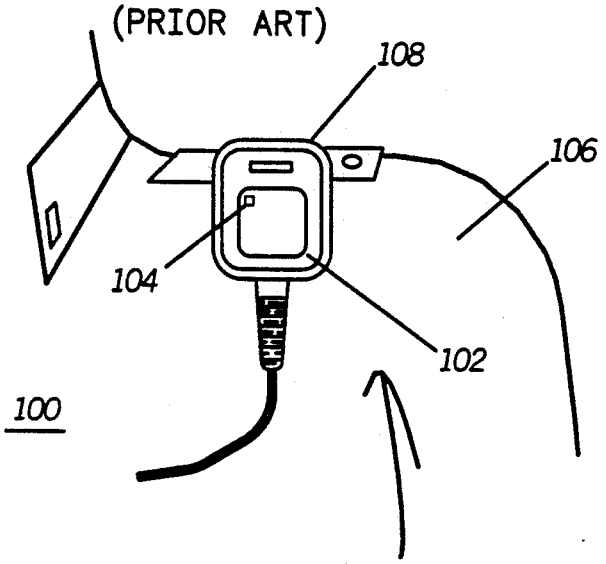
FIG.1 (PRIOR ART)
FIG. 1 is a diagram of the attachment of a microphone to the clothing of an operator in accordance with the present invention.
Figure 4:
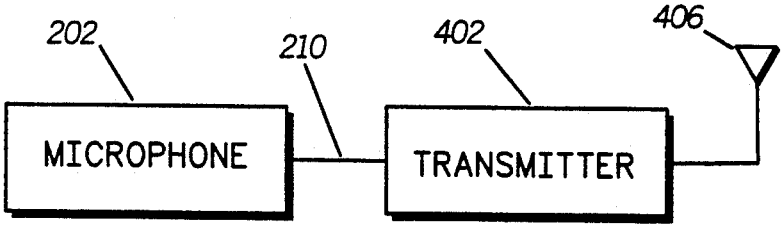
FIG. 4 is a block diagram of a transmitter in accordance with the present invention.

Referring to FIG. 4, a block diagram of a transmitter is shown in accordance with the present invention. A transmitter 402 is coupled to the microphone 202 via the microphone cable 210. The audio signals from the microphone 202 are routed to the transmitter 402 for transmission via an antenna 406. The microphone 202 is attached to a person's clothing via the velcro patch 208 which dampens the sound levels reaching the rear port 204. Such dampening of the sound levels at the rear port 204 reduces the effects of noise cancellation which is inherent in directional microphones.

Figure 5:
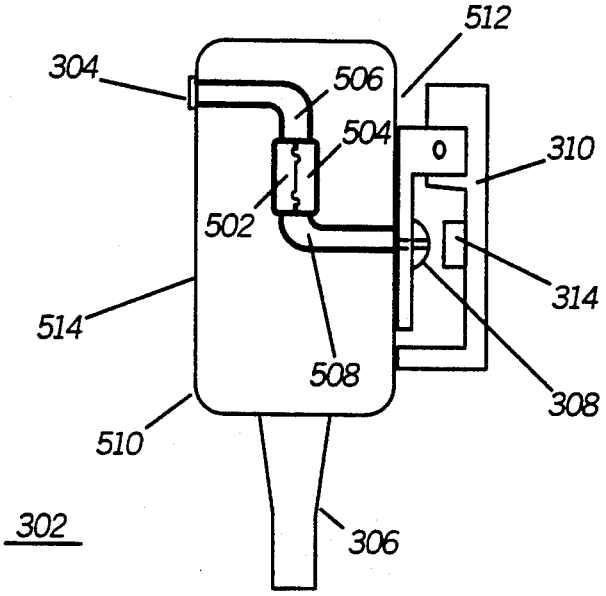
FIG. 5 is a diagram of the internal elements of a microphone in accordance with the present invention.

Referring now to FIG. 5, the internals of microphone 302 are shown. The microphone 302 includes a housing 510 which has a front side 514 and a back side 512. The front port 304 and the rear port 308 are coupled to front side 514 and rear side 512 respectively. A microphone element 502 is shown as the transducer means for converting sound waves to electrical signals. The front port 304 and the rear port 308 are coupled to the front and rear inlets 506 and 508 respectively via extension tubings. A diaphragm 504 senses the difference between the instantaneous air pressure which impinges on its two surfaces. This pressure difference at the diaphragm 504 causes it to move, and this mechanical movement is converted to an electrical output signal by the microphone element 502. The clip 310 is placed in close proximity to the rear port 308 so as to block it when the microphone 302 is attached to the person's clothing 312.

To summarize, as is known, the operation of a directional microphone is hampered when the user of these microphones doesn't speak directly into them. It is further known that most of remote microphones are intended for attachment to the clothing of the user. Such attachments greatly hamper the direct path of sound waves, generated by the user, to the microphone resulting in performance degradation. This invention minimizes performance degradation of directional microphones when used remotely. A directional microphone 302 having a front port 304 and a rear port 308 is attached to a user's clothing. The mounting of the microphone 302 results in the pad 314 pushing a portion of the clothing of the user against the rear port 308 resulting in its blockage. This blocking results in the removal of the contribution of the rear port 308 to the operation of the directional microphone 302. Consequently, the user doesn't have to directly speak into the microphone 302 in order to achieve acceptable performance.

What is claimed is:

1. A noise cancelling microphone, comprising:

a housing having first and second sides;

a sound transducer mounted within the housing, the transducer having first and second sound ports coupled to the first and second sides of the housing respectively; and mounting means coupled to one side of the housing in the proximity of the second sound port for mounting the microphone to a user so as to selectively and substantially close the second sound port when the microphone is attached to the user.

2. The noise cancelling microphone of claim 1, wherein the mounting means includes hook and loop fastener means.

3. The noise cancelling microphone of claim 1, wherein the mounting means includes a clip.

4. The noise cancelling microphone of claim 3, wherein the clip includes a pressure pad.

5. The noise cancelling microphone of claim 1, wherein the sound transducer includes a directional transducer.

6. A portable microphone apparatus adapted to be mounted on a person's clothing, comprising:

a microphone element for converting sound waves to electrical signals, the microphone element having a first and a second port operating in combination to substantially prevent the ambient noise from being converted to electrical signals; and fastening means attached to the portable microphone for fastening the portable microphone to the person's clothing so as to selectively and substantially block the second port.

7. A communication device, comprising:

transmitter means for transmitting a signal;

microphone means coupled to the transmitter means for converting sound waves to electrical signals, the microphone means including:

a housing having a first and a second side;

a transducer means mounted within the housing and having a first and a second port coupled to the first and second sides of the housing respectively for substantially cancelling ambient noise;

fastening means attached to the second side of the microphone means, substantially close to the second port of the transducer, for fastening the microphone means to a person's clothing so as to selectively block the second port.

8. The communication device of claim 7, wherein the fastening means includes hook and loop fastener means.

9. The communication device of claim 7, wherein the fastening means includes a clip.

10. The communication device of claim 7, wherein the transducer means includes a directional transducer.

* * * * *